United States Patent [19]

Onishi

[11] 4,359,662

[45] Nov. 16, 1982

[54] FLASH DISCHARGE LAMP

[75] Inventor: Yasuo Onishi, Himeji, Japan

[73] Assignee: Ushio Denki Kabushikikaisha, Tokyo, Japan

[21] Appl. No.: 130,534

[22] Filed: Mar. 14, 1980

[30] Foreign Application Priority Data

Jul. 11, 1979 [JP] Japan ..... 54-86939

[51] Int. Cl.[3] ..... H01J 17/18; H01J 17/04

[52] U.S. Cl. ..... 313/213; 313/220; 313/246; 313/253; 313/283

[58] Field of Search ..... 313/213, 220, 246, 249, 313/250, 252, 253, 267, 274, 283, 291, 216

[56] References Cited

U.S. PATENT DOCUMENTS 3,449,614 6/1969 Myers ..... 313/220 X 3,650,593 3/1972 Kerekes ..... 313/220 X

*Primary Examiner*—Marvin L. Nussbaum

*Attorney, Agent, or Firm*—Staas & Halsey

[57] ABSTRACT

A flash discharge lamp in which a tubular glass bulb is sealed at both ends by a cathode metal cap and an anode metal cap, respectively; a cathode material member is mounted on the top of an intermediate member planted on the bottom of the cathode metal cap; an adhesive is tamped in the gap between each of the metal caps and the outer peripheral surface of the tubular glass bulb; and a discharge is produced between the anode metal cap and the cathode material member.

24 Claims, 7 Drawing Figures

FLASH DISCHARGE LAMP

BACKGROUND OF THE INVENTION

1. Field of the Invention

This invention relates to a flash discharge lamp suitable for use as a strobo gun which is incorporated in a camera.

2. Description of the Prior Art

There has been a strong and growing demand for miniaturization of flash discharge lamps since strobo guns were first built in cameras.

Conventionally, use has been made of a flash discharge lamp structure such as that shown in FIG. 1. This structure includes an anode 2 made of tungsten a lead rod 4 made of tungsten and carrying at one end a cathode material member 3, which are hermetically sealed in a tubular glass bulb 1 at both ends thereof. The glass bulb has hermetically sealed therein a light emissive gas. In the case of miniaturizing such a flash discharge lamp, the hermetically sealed portions $l_1$ cannot be greatly reduced, and consequently there is no choice but to reduce the size of the light emitting portion $l_2$. This inevitably introduces difficulties both in obtaining the required quantity of light and in manufacturing the discharge lamp.

SUMMARY OF THE INVENTION

Accordingly, it is an object of this invention to provide a novel flash discharge lamp which is easy to manufacture, extremely small in size, inexpensive and performs excellently both in the quantity of light and, in radiation efficiency as compared with conventional flash discharge lamps.

The above object is achieved by providing a flash discharge lamp which comprises a tubular glass bulb, a cathode metal cap, having a widened open and portion, sealed to one end of the glass bulb an anode metal cap, having a widened open end portion sealed to the other end of the glass bulb, a cathode material member mounted on an intermediate member extending from the bottom of the cathode metal cap, and an adhesive filled in the gap between the outer peripheral surface of the glass bulb and each of the metal caps. A discharge is produced between the bottom of the anode metal cap and the cathode material member.

DESCRIPTION OF THE PREFERRED EMBODIMENTS

Figure 1:
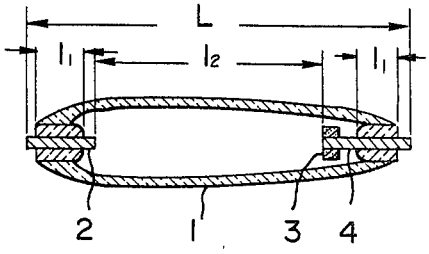
FIG. 1 is a cross-sectional view of a conventional flash discharge lamp.
Figure 2:
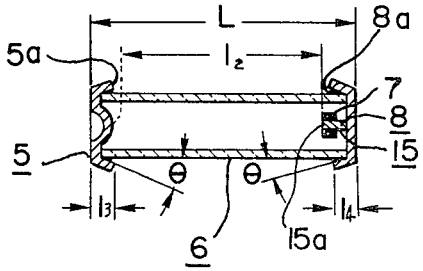
FIG. 2 is a cross-sectional view of an example of the flash discharge lamp of this invention.
Figure 3:
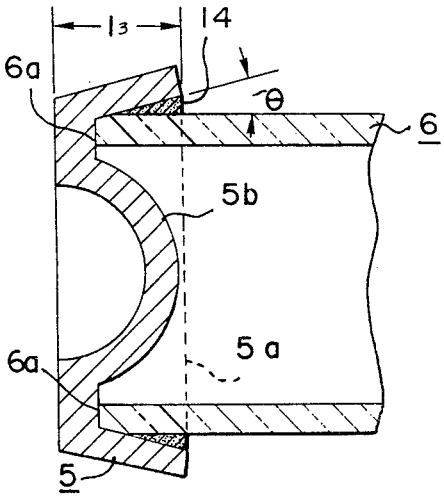
FIG. 3 is an enlarged view showing the anode metal cap sealed portion of FIG. 2.
Figure 4:
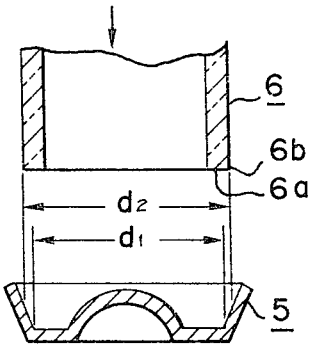
FIG. 4 is a diagram for explaining the sealing of anode metal cap 5 to tubular glass bulb 6 of FIG. 2.

In FIG. 2 there is illustrated an embodiment of the flash discharge lamp of the present invention. Reference numeral 5 indicates an anode metal cap which is made of an iron-nickel-cobalt alloy, such as Covar (trademark), and has a thickness of 0.2 mm and a depth $l_3$ of about 1.5 mm. Its open end portion 5*a* is widened by an angle $\theta$ of about 7° and the height of the central portion 5*b* raised from the bottom of the metal cap 5 is selected substantially equal to the depth of the cap 5, as shown in FIG. 3. As will be described later, the raised central portion 5*b* is used as an anode. The anode need not always be raised as indicated by 5*b* but may also be held flat; but, when the discharge surface of the anode is flush with the sealed portion of a bulb and the cap 5, arc may sometimes touch the sealed portion which would result in the bulb 6 being eventually broken in long use. Accordingly, the flat anode presents a problem in terms of reliability. The bulb 6 is a tubular glass bulb formed of Covar glass which has substantially the same coefficient of expansion as the above-mentioned Covar alloy, and its outer diameter $d_2$ is 3 to 5 mm. The anode metal cap 5 is hermetically sealed to the glass bulb 6 in the following manner: In argon, nitrogen or like non-oxidizing atmosphere the anode metal cap 5 is heated up to about 800° C. by high-frequency heating, a carbon heater or the like, and then one end face 6*a* of the bulb 6 is pressed against the anode metal cap 5 to hermetically seal them to each other. This sealing operation is illustrated in FIG. 4. The diameter $d_1$ of the bottom of the anode metal cap 5 and the outer diameter $d_2$ of the tubular glass bulb 6 are selected so that $d_2 > d_1$. As the glass bulb 6 is pressed against the metal cap 5 in the direction of arrow, the glass bulb 6 is softened from its edge 6*b* and the end face 6*a* reaches the bottom of the metal cap 5 and is sealed thereto. It is easier to obtain a complete vacuum, hermetic structure by such a method rather than by directly sealing the bottom of the metal cap 5 and the end face 6*a* of the glass bulb 6.

Reference numeral 7 designates a cathode material member having an alkali or alkali earth metal contained in a heat-proof metal. The cathode material member 7 is connected to the bottom of a cathode metal cap 8 through an intermediate member 15 which is a rod made of thoriated tungsten.

The cathode metal cap 8 is also formed of Covar and has a thickness of 0.2 mm and a depth $l_4$ of about 1.5 mm. It open end portion 8*a* is widened by an angle $\theta$ of about 7° as is the case with the anode metal cap 5.

The cathode metal cap 8 can be sealed to the glass bulb 6 as described above.

Figure 5:
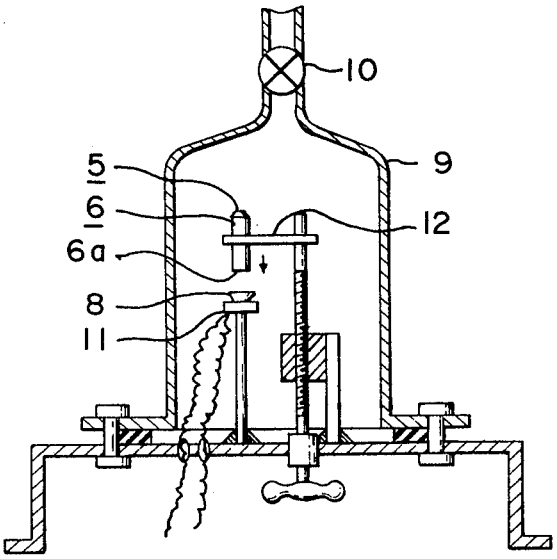
FIG. 5 is a diagram illustrating one of the steps for manufacturing the flash discharge lamp shown in FIG. 2.

FIG. 5 shows one of steps involved in the manufacture of the flash discharge lamp of this invention. Reference numeral 9 indicates a bell jar; 10 designated a cock for evacuating the bell jar or for supplying a necessary gas thereto; and 11 identifies a high-frequency heating head. In the bell jar 9, the glass bulb 6 having the anode metal cap 5 is placed opposite the cathode metal cap 8, using a support 12. After evacuating the bell jar 9, a gas, for example, xenon gas is pumped in the bell jar 9 and then the cathode metal cap 8 is heated by the high-frequency heating head 11 up to about 800° C. Next, the glass bulb 6 is moved (as by moving the support 12) in the direction of the arrow to lightly press the end face 6*a* of the glass bulb 6 against the bottom of the cathode metal cap 8, thus sealing them together. Thereafter, cooling takes place. In this case, the flash discharge lamp is filled with the xenon gas and its pressure is substantially equal to the pressure at which the gas is charged into the bell jar. Accordingly, this flash discharge lamp has no evacuation hole but a charged gas pressure higher than 1 atmospheric pressure (25° C.) can be easily obtained.

Figure 6:
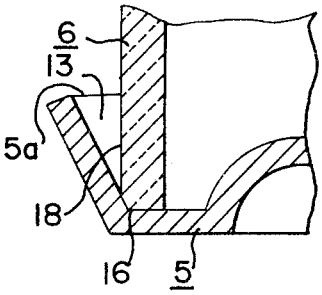
FIG. 6 is an enlarged view showing the sealing of the anode metal cap to the glass bulb.

FIG. 6 shows on an enlarged scale the sealed portion of the anode metal cap 5 and the glass bulb 6.

Since the open end portion 5*a* of the anode metal cap 5 is widened by the angle $\theta$ as described previously, a V-shaped gap 13 is defined by the anode metal cap 5 and the outer peripheral surface 18 of the glass bulb 6.

An adequate hermetic seal of the flash discharge lamp is achieved by the seal 16 between the glass bulb 6 and the metal cap 5. However, this does not provide sufficient mechanical strength, so an adhesive 14 (see FIG. 3), for example, Rock-Tight (trade name of an organic adhesive sold by Nihon Sealant Kabushiki Kaisha) is tamped into the V-shaped gas 13, thereby firmly binding glass bulb 6 and the metal cap 5. The adhesive 14 need not always be limited specifically to the aforesaid organic one but may also be glass frit. This ensures prevention of breakage of the flash discharge lamp during handling even if the pressure of the gas charged therein is higher than 1 atmospheric pressure.

The cathode metal cap 8 is sealed to the glass bulb 6 in the same manner as the anode metal cap 5 is sealed to the latter, as shown in FIGS. 3, 4 and 6.

As described above, by widening the open end portion of each metal cap by the angle $\theta$, the diameters $d_1$ and $d_2$ can be selected to bear the relationship, $d_1 < d_2$, to obtain a completely hermetically sealed bulb structure, and an adhesive can be filled in the V-shaped gap between the cap and the glass bulb to provide for enhanced mechanical strength of the bulb structure.

Next, a description will be given of an embodiment of the flash discharge lamp of this invention designed for testing its lifetime. The length $l_2$ of the light emitting portion of the lamp was 15 mm and the entire length of the lamp was made as small as about 20 mm. Xenon gas was charged into the lamp at 25° C. under a pressure of 900 mmHg; the outer diameter of the glass bulb was 3.2 mm; a condenser capacitance was 275 $\mu$F; and the energy J for each firing was 15 joules. Under such conditions, the flash discharge lamp withstood about 3000 firings. With the flash discharge lamp of this invention, the required quantity of light can be readily obtained partly because the length $l_2$ of the light emitting portion can be made relatively long with respect to the entire length L of the lamp and partly because the gas can be charged under a relatively high pressure.

Figure 7:
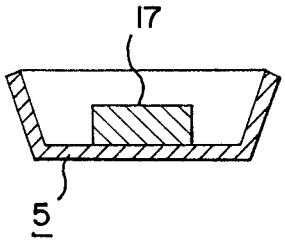
FIG. 7 illustrates an anode metal cap 5 having a heat-proof metal chip.

The lifetime of the flash discharge lamp can be further extended by welding a tungsten chip 17 for example, 1 to 2 mm high, to the bottom of the anode metal cap 5 (FIG. 7) or by coating the bottom with tantalum or the like for receiving arc of flash discharge. In this case, it is preferred that the ratio $J/Q_2$ between the total thermal capacity $Q_2$ (joule/°C.) of the anode metal cap and the heat-proof metal chip or the heat-proof metal coating and the energy J (joule) for each firing is 100 or more. It has been ascertained experimentally that if the total thermal capacity $Q_2$ is too large, the temperatures of the anode metal cap and the heat-proof metal chip do not rise sufficiently during discharge and heat is absorbed from arc in the vicinity of the heat-proof metal chip to the side of the anode metal cap to cause a decrease in the radiation efficiency which appears to be caused by lowered arc temperature. Accordingly, the radiation can be increased by defining the relationship between the firing energy J passing through the heat-proof metal chip and the anode metal cap and their total thermal capacity $Q_2$ so that the temperatures of the metal chip and the anode metal cap may be raised by each firing to some extent. Experiments revealed that when the ratio $J/Q_2$ exceeded 100, the radiation efficiency was sufficiently high.

As a result of studies of the flash discharge lamp of this invention, the following facts have been found.

(1) It is preferred that the ratio $J/Q_1$ between the total thermal capacity $Q_1$ (joule/°C.) of the cathode metal cap, the intermediate member and the cathode material member and the energy J (joule) for each firing is 10 or more. With the ratio $J/Q_1$ being 10 or more, arc in the vicinity of the cathode material member is intensified to enhance the brightness of arc at that portion. This is supposed to be caused by the thermal conditions of the cathode material member and its vicinity.

(2) It is preferred that the open end portion of each metal cap is widened 2° or more. The angle $\theta$ of 2° or more allows ease in filling of the adhesive in the gap between the glass bulb and each metal cap, prevents the end face of the glass bulb from being sealed to the open end portion of each metal cap, and ensures to production of a flash discharge lamp of correct size and shape.

Too large an angle $\theta$ is not desirable from the standpoint of miniaturization; however, if the metal cap is about 1 to 2.5 mm deep, the angle $\theta$ of about 10° does not present any problem in practical use.

(3) It is preferred that the thickness of each metal cap is in the range from 0.1 to 0.3 mm. In the present invention, the sealing of the metal cap and glass bulb is not what is called "house keeper seal" but is rather butt welding; consequently, if the metal cap is thicker than 0.3 mm, the glass bulb is liable to crack.

If the metal cap is thinner than 0.1 mm, its bottom may sometimes be broken during welding of the intermediate member or the heat-proof metal chip or by the shock of an instantaneous large current during discharge. A metal cap thickness in the range of 0.1 to 0.3 mm facilitates the fabrication of the flash discharge lamp and provides for good performance.

(4) In the case where the intermediate member is formed of tungsten or thoriated tungsten, it is desirable that the tip 15*a* of the intermediate member 15 extends a short distance above the cathode material member 7 towards the anode metal cap 5. In this case, the tip of the tungsten or thoriated tungsten receives the main arc stream, thereby preventing wear of the cathode material member.

As has been described above, the flash discharge lamp of this invention is easy to manufacture, extremely small, inexpensive and excellent in the quantity of light and in radiation efficiency. Thus, it is suitable for use as a strobo gun which is built in a camera.

It will be apparent that many modifications and variations may be effected without departing from the scope of the novel concepts of this invention.

What is claimed is:

1. A flash discharge lamp comprising:

a glass cylinder having an outer surface and having first and second open ends;

a continuous cathode metal cap, having a disc portion and having a sealing wall extending from said disc portion at an angle thereto, said first open end of said glass cylinder sealed to said continuous cathode metal cap, said disc portion of said continuous cathode metal cap having an inner face and an outer face;

a continuous anode metal cap, having a disc portion and having a sealing wall extending from said disc portion at an angle thereto, said second open end of said glass cylinder sealed to said continuous anode metal cap, said disc portion of said continuous anode metal cap having an inner face and an outer face;

an intermediate member, having a free end, extending from said inner face of said disc portion of said continuous cathode metal cap;

a cathode material member extending from the free end of said intermediate member such that said intermediate member and said cathode material member are positioned inside said glass cylinder; and an adhesive material filled in the gap between the outer surface of said glass cylinder and the sealing walls of said continuous anode and cathode metal caps, wherein a discharge is generated between said continuous anode metal cap and said cathode material member.

2. A flash discharge lamp as set forth in claim 1, wherein a central portion of said disc portion of said continuous anode metal cap projects inwardly toward said cathode material member.

3. A flash discharge lamp as set forth in claim 1, wherein said continuous anode metal cap further comprises a heat-proof metal chip extending from the inner face of said disc portion of said continuous anode metal cap such that said heat-proof metal chip is positioned inside said glass cylinder, wherein said discharge is generated between said heat-proof metal chip and said cathode material member.

4. A flash discharge lamp as set forth in claim 3, wherein said heat-proof metal chip is made of tungsten.

5. A flash discharge lamp as set forth in claim 1, wherein said continuous anode metal cap further comprises a heat-proof metal coated on the inner face of said disc portion of said continuous anode metal cap, wherein said discharge is generated between said heat-proof metal coating and said cathode material member.

6. A flash discharge lamp as set forth in claim 5, wherein said heat-proof metal coating comprises tantalum.

7. A flash discharge lamp as set forth in claim 1, wherein said intermediate member is a tungsten rod.

8. A flash discharge lamp as set forth in claim 1, wherein said intermediate member is a thoriated tungsten rod.

9. A flash discharge lamp as set forth in claim 1, wherein a ratio $J/Q_1$, where $Q_1$ is the total thermal capacity (joule/°C.) of said continuous cathode metal cap, said intermediate member and said cathode material member and where J is the energy (joule) for each firing, is defined as follows:

$$J/Q_1 \geqq 10.$$

10. A flash discharge lamp as set forth in claim 1, 2, 3, 4, 5, 6, 7, 8 or 9, wherein the angle between the outer surface of said glass cylinder and said sealing walls of said continuous anode and cathode metal caps is greater than 2°.

11. A flash discharge lamp as set forth in claim 1, 2, 3, 4, 5, 6, 7, 8 or 9, wherein each of said continuous anode and cathode metal caps is 0.1 to 0.3 mm. thick.

12. A flash discharge lamp as set forth in claim 1, 2, 3, 4, 5, 6, 7, 8 or 9, wherein the diameter $d_1$ of said disc portion of said continuous anode and cathode metal caps and the outer diameter $d_2$ of said glass cylinder are selected such that $d_2$ is greater than $d_1$.

13. A flash discharge lamp as set forth in claim 3, wherein a ratio $J/Q_1$, where $Q_1$ is the total thermal capacity (joule/°C.) of said continuous cathode metal cap, said intermediate member and said cathode material member and where J is the energy (joule) for each firing, is defined as follows:

$$J/Q_1 \geqq 10,$$

and wherein a ratio $J/Q_2$, where $Q_2$ is the total thermal capacity (joule/°C.) of said continuous anode metal cap and said heat-proof metal chip, is defined as follows:

$$J/Q_2 \geqq 100.$$

14. A flash discharge lamp as set forth in claim 5, wherein a ratio $J/Q_1$, where $Q_1$ is the total thermal capacity (joule/°C.) of said continuous cathode metal cap, said intermediate member and said cathode material member and where J is the energy (joule) for each firing, is defined as follows:

$$J/Q_1 \geqq 10,$$

and wherein a ratio $J/Q_2$, where $Q_2$ is the total thermal capacity (joule/°C.) of said continuous anode metal cap and said heat-proof metal coating, is defined as follows:

$$J/Q_2 \geqq 100.$$

15. A flash discharge lamp comprising:

a tubular glass bulb having first and second ends;

a cathode metal cap, sealed to said first end of said glass bulb, having a widened open end portion and having a bottom portion;

an anode metal cap, sealed to said second end of the glass bulb, having a widened open end portion and a bottom portion;

an intermediate member extending from the bottom portion of said cathode metal cap, said intermediate member having a top end portion;

a cathode material member mounted on said top end portion of said intermediate member;

an adhesive filled in a gap between the outer peripheral surface of said glass bulb and said cathode and anode metal caps; and a heat-proof metal chip extending from the bottom portion of said anode metal cap such that a discharge is produced between said heat-proof metal chip and said cathode material member.

16. A flash discharge lamp comprising:

a tubular glass bulb having first and second ends;

a cathode metal cap, sealed to said first end of said glass bulb, having a widened open end portion and having a bottom portion;

an anode metal cap, sealed to said second end of the glass bulb, having a widened open end portion and having a bottom portion which is coated with a heat-proof metal;

an intermediate member extending from the bottom portion of said cathode metal cap, said intermediate member having a top end portion;

a cathode material member mounted on said top end portion of said intermediate member, such that a discharge is produced between said heat-proof metal coating and said cathode material member;

an adhesive filled in a gap between the outer peripheral surface of said glass bulb and said cathode and anode metal caps.

17. A flash discharge lamp according to claim 15, wherein the central portion of the bottom portion of said anode metal cap projects toward said cathode material member.

18. A flash discharge lamp according to claim 15 or 16, wherein said intermediate member is a rod made of one of tungsten and thoriated tungsten.

19. A flash discharge lamp according to claim 15 or 16, wherein a ratio $J/Q_1$; where $Q_1$ is the total thermal capacity (joule/°C.) of said cathode metal cap, said intermediate member and said cathode material member and where J is the energy (joule) for each firing, is defined as follows:

$$J/Q_1 \geqq 10.$$

20. A flash discharge lamp according to claim 15, 16 or 17, wherein the open end portions of said anode and cathode metal caps are widened by an angle $\theta$ of 2° or more, where $\theta$ is defined by the angle between the open end portions and the outer peripheral surface of said glass bulb.

21. A flash discharge lamp according to claim 15, 16 or 17, wherein each of said anode and cathode metal caps is 0.1 to 0.3 mm.thick.

22. A flash discharge lamp according to claim 15, 16 or 17, wherein the inner diameter $d_1$ of the bottom portion of each of said anode and cathode metal caps and the outer diameter $d_2$ of the glass bulb are selected such that $d_2 > d_1$.

23. A flash discharge lamp as set forth in claim 15, wherein a ratio $J/Q_1$, where $Q_1$ is the total thermal capacity (joule/°C.) of said cathode metal cap, said intermediate member and said cathode material member and where J is the energy (joule) for each firming, is defined as follows:

$$J/Q_1 \geqq 10,$$

and wherein a ratio $J/Q_2$, where $Q_2$ is the total thermal capacity (joule/°C.) of said anode metal cap and said heat-proof metal chip, is defined as follows:

$$J/Q_2 \geqq 100.$$

24. A flash discharge lamp as set forth in claim 16, wherein a ratio $J/Q_1$, where $Q_1$ is the total thermal capacity (joule/°C.) of said cathode metal cap, said intermediate member and said cathode material member and where J is the energy (joule) for each firing, is defined as follows:

$$J/Q_1 \geqq 10,$$

and wherein a ratio $J/Q_2$, where $Q_2$ is the total thermal capacity (joule/°C.) of said anode metal cap and said heat-proof metal coating, is defined as follows:

$$J/Q_2 \geqq 100.$$

* * * * *

UNITED STATES PATENT AND TRADEMARK OFFICE

CERTIFICATE OF CORRECTION

PATENT NO. : 4,359,662

DATED : NOVEMBER 16, 1982

INVENTOR(S) : YASUO ONISHI.

It is certified that error appears in the above-identified patent and that said Letters Patent is hereby corrected as shown below:

Col. 2, line 45, "It" should be --The--;
line 51, "designated" should be --designates--.
Col. 3, line 16, "gas" should be --gap--.
Col. 4, line 4, "efi" should be --effi- --.
Col. 5, line 68, "portion" should be --portions--.

Signed and Sealed this

*Twenty-second* Day of *March 1983*

[SEAL]

*Attest:*

GERALD J. MOSSINGHOFF

*Attesting Officer*

*Commissioner of Patents and Trademarks*